United States Patent [19]

Yasukawa et al.

[11] Patent Number: 4,672,825

[45] Date of Patent: Jun. 16, 1987

[54] ANTISTATIC COVER

[75] Inventors: Akio Yasukawa, Higashiosaka; Yoshihiro Misuna, Osaka, both of Japan

[73] Assignee: Katsura Roller Mfg. Co., Ltd., Japan

[21] Appl. No.: 806,231

[22] Filed: Dec. 6, 1985

[30] Foreign Application Priority Data

Dec. 6, 1984 [JP] Japan ..... 59-185645[U]
Dec. 6, 1984 [JP] Japan ..... 59-185646[U]

[51] Int. Cl.[4] ..... D04B 7/12; D04B 7/16
[52] U.S. Cl. ..... 66/194; 66/202
[58] Field of Search ..... 66/169, 176, 171, 202; 361/221; 57/901

[56] References Cited

U.S. PATENT DOCUMENTS

| | | | |
|---|---|---|---|
| 2,345,337 | 3/1942 | Gardner . | |
| 2,804,762 | 6/1954 | Kameda . | |
| 2,958,146 | 4/1955 | Van Dusen, Jr. et al. . | |
| 3,067,779 | 12/1962 | Draper | 139/383 A |
| 3,242,554 | 3/1966 | Raymond | 66/202 |
| 3,273,224 | 10/1963 | Spicer . | |
| 3,699,590 | 10/1972 | Webber et al. | 57/901 |
| 3,785,178 | 1/1972 | Machacek et al. . | |
| 3,926,701 | 12/1975 | Nishiwaki | 66/194 |
| 3,986,530 | 10/1976 | Maekawix | 66/202 |
| 4,019,350 | 3/1974 | Schmidt . | |
| 4,232,082 | 11/1980 | Noritake | 57/901 |
| 4,322,232 | 3/1982 | Beane | 66/170 |
| 4,400,418 | 6/1982 | Takeda et al. . | |
| 4,420,529 | 12/1983 | Westhead | 139/383 A |
| 4,531,386 | 7/1985 | England et al. | 66/202 |
| 4,557,968 | 12/1985 | Thornton | 57/901 |

FOREIGN PATENT DOCUMENTS 528482 10/1940 United Kingdom .

*Primary Examiner*—Ronald Feldbaum
*Attorney, Agent, or Firm*—Jones, Tullar & Cooper

[57] ABSTRACT

An antistatic cover is composed of a tubular knitted fabric comprising water-shrinkable or heat-shrinkable ground yarns which are alternately knitted to form a needle loop in a course of a ground fabric so that each sinker loop of the ground fabric has a width longer than that of the needle loop, at least one of the ground yarns comprising charge control fibers or electrically conductive fibers. Pile yarns may be worked into each course of the ground fabric by alternately knitting together with a needle mesh of the ground fabric to form a needle loop. At least one of the ground yarns and pile yarns comprises charge control fibers or conductive fibers.

4 Claims, 6 Drawing Figures

ANTISTATIC COVER

CROSS REFERENCE TO RELATED APPLICATION

This application contains subject matter in common with application, Ser. No. 904,801, which is a continuation of application, Ser. No. 694,175.

This invention relates to an antistatic cover and, more particularly, to a cover for eliminating electrostatic charge from objects.

DESCRIPTION OF THE PRIOR ART

In general, when different objects are rubbed together, electricity is generated and stored on surfaces of the objects. Such phenomenon can be found in various devices for commercial and industrial use. For example, in a paper feeder arranged in an electrophotographic copying apparatus, a roller comes in contact with a sheet of paper and may be given electrostatic charges by friction. If a large quantity of electrostatic charge is stored on the surface of the roller, paper and dust become stuck thereon, resulting in mechanical trouble and lowering of copy quality. Similar problems are also found in rollers of an offset press, film casting machines, and the like.

To eliminate electrostatic charges from these rollers, a belt like cloth fixed with organic conductive fibers is spirally wound on the roller so that the cloth comes in contact with paper.

However, such a cloth includes various problems awaiting a solution. For example, the cloth must be fixed at its both ends to the roller with an adhesive material or an adhesive-backed tape. In addition, the cloth is apt to be loosened by lowering of adhesive force of the adhesive material as the time goes. If the roller has a coller, it is difficult to wind the cloth around the roller. The organic conductive fibers fixed to the cloth are apt to fall off, so that the fibers could accumulate in the machine and cause a fire.

It is therefore an object of the present invention to provide an antistatic cover which is easy to attach, and high in aging resistance and safety.

Another object of the present invention is to provide a cover for preventing rollers from the accumulation of electrostatic charges.

SUMMARY OF THE INVENTION

According to the present invention, these objects are achieved by providing an antistatic cover composed of a tubular knitted fabric comprising water-shrinkable or heat-shrinkable ground yarns, each of the ground yarns being alternately knitted to form a needle loop in a course of a ground fabric so that each sinker loop of the ground fabric has a width longer than that of the needle loop, at least one the ground yarns comprising charge control fibers or electrically conductive fibers.

According to the present invention, there is further provided an antistatic cover composed of a tubular knitted fabric comprising water-shrinkable or heat-shrinkable ground yarns and pile yarns, each of said ground yarn being alternately knitted to form a needle loop in a course of a ground fabric so that each sinker loop of the ground fabric has a width longer than that of the needle loop, each of said pile yarns worked into each course of the ground fabric being alternately knitted together with a needle mesh of the ground fabric to form a needle loop, at least one of the ground yarns and pile yarns comprising charge control fibers or conductive fibers.

As the ground yarns, there may be used-any of the known water-shrinkable or heat-shrinkable yarns such as, for example, yarns composed of non-acetalized polyvinyl alcohol fibers, or chemical fibers, or reproduced fibers, or natural fibers. When the tubular fabric is composed of two ground yarns, one of the ground yarns may be a yarn composed of charge control fibers or conductive fibers, or a union yarn comprising charge control fibers or conductive fibers, or a twisted yarn composed of one or more yarns of charge control fibers or conductive fibers and one or more water-shrinkable or heat-shrinkable yarns.

As the pile yarns, there may be used any of the known hydrophilic yarns such as, for example, yarns composed of viscose rayon fibers, acetate fibers. The pile yarn may be a yarn composed of charge control fibers or conductive fibers, or a union yarn comprising charge control fibers or conductive fibers, or a twisted yarn composed of one or more yarns of charge control fibers or conductive fibers and one or more water-shrinkable or heat-shrinkable yarns. The pile yarn may be of heat-adhesive fibers such as, for example, Toray Elder (Trade name). The use of heat-adhesive fiber yarns makes it possible to prevent the fabric from fraying out.

Any of the known charge control fibers and conductive fibers may be used as a material for ground yarns and pile yarns. The charge control fibers includes, without being limited to, organic semiconductive fibers containing fine carbon particles dispersed in a base polymer, such as "Toray SA-7" (Trade mark) produced by Toray Co. The conductive fibers includes, without being limited to, metal fibers such as fibers of copper or stainless steel.

The present invention will be further apparent from the following description with reference to the accompanying drawings, which show by way of example only, preferred embodiments thereof.

DETAILED DESCRIPTION OF THE INVENTION

Figure 1:
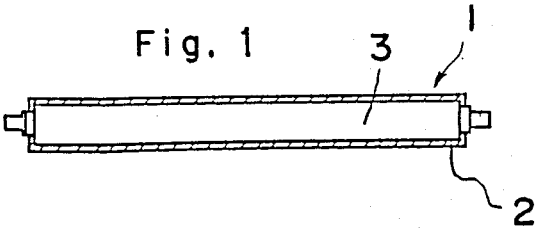
FIG. 1 is a sectional view of a roller provided with an antistatic cover according to the present invention.
Figure 2:
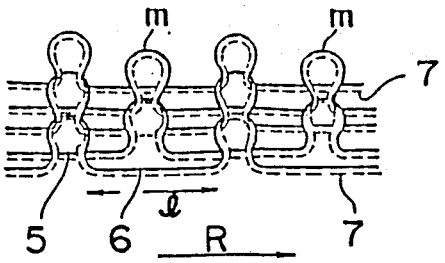
FIG. 2 is a view showing a fabric according to the present invention.
Figure 3:
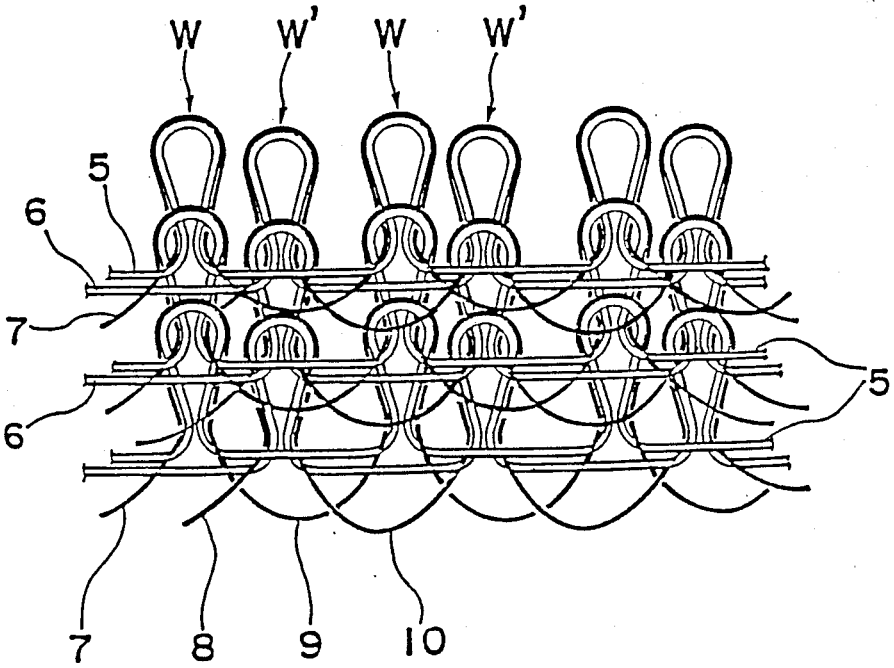
FIG. 3 is a more detailed view of the fabric shown in FIG. 2.

Referring now to FIG. 1, there is shown a roller 1 provided with an antistatic cover 2 according to the present invention. The cover 2 is composed of a tubular double plain knitted fabric comprising two ground yarns 5 and 6, and two pile yarns 7 and 8, as shown in FIGS. 2 and 3. The tubular ground fabric is formed by alternately knitting two ground yarns to form a course composed of two successively worked partial courses so that the needle meshes in each course lie in a straight line. In each course of the ground fabric, the needle loops are alternately formed of one of the two ground yarns 5 and 6 and each sinker loops has a width l longer than that of the needle loop m. Thus, wales, W, of one plain knitted structure are formed by the ground yarn 5, while the other wales, W', are formed by the other ground yarn 6. Each of two pile yarns 7 and 8 worked into each course of the ground fabric is alternately knitted together with the needle mesh of the ground fabric to form a needle loop. The raised loops 9, 10 are alternately formed of one of the pile yarn. The raised loops 9, 10 may be cut by shearing to form tufts or cut loops.

In FIGS. 2 and 3, the courses formed by the ground yarn 6 are illustrated as if they were formed in positions slightly shifted downwardly from the courses formed of the ground yarn 5, for the better understanding of the double plain knitted structure.

Figure 4:
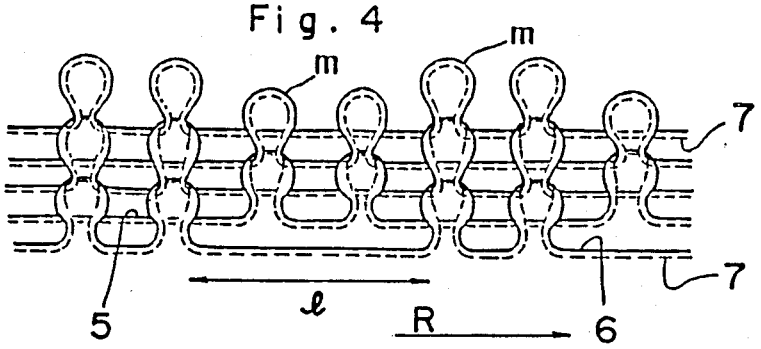
FIG. 4 is a view of a fabric according to the present invention.

The ground fabric shown in FIG. 4 is the same as the one described with reference to FIG. 2 except for that two needle loops are alternately formed in pairs of one of the two ground yarns 5 and 6.

According to the present invention it is possible to obtain an antistatic cover having a high radial shrinking percentage and a high axial shrinking percentage. For example, it is possible to obtain a cover having a radial shrinking percentage of 20 to 25% and an axial shrinking percentage of 25 to 30%, using ground yarns composed of a water-shrinkable fibers of non-acetalized polyvinyl acetate (shrinking percentage: 25%) and hydrophilic pile yarns composed of viscose rayon fibers (shrinking percentage: 3%). Thus, the antistatic cover of the present invention is securely fastened to a roller by thoroughly wetting or heating the cover mounted on the roller so that the water-shrinkable or heat shrinkable ground yarn shrinks causing fabric to tighten down on the roller. Also, the tubular fabric ensures that a uniform shrinking force is applied to every part of the roller, thus making it possible to prevent the cover from loosening for a long period.

If the roller provided with the antistatic cover of the present invention is assembled in a paper feeder of a electrophotographic copying apparatus and is driven to continuously feed sheets of paper, the cover is given positive or negative electric charge by friction so that the charge control fibers in the fabric are induced opposite electric charge by electrostatic induction. The induced charge causes a high electric field close to the charge control fibers, resulting in ionization of air due to corona discharge. The ionized air neutralizes the electric charge stored on the surface of the cover, resulting in elimination of the electrical charge from the cover and roller.

EXAMPLE 1

Antistatic covers, A, B, C and D composed of the tubular fabric shown in FIG. 2 were prepared by knitting two ground yarns and two pile yarns with a circular knitting machine comprising a 3 inch cylinder provided with 96 needle grooves, 32 high butt needles and 32 low butt needles, and a sinker dial having 96 sinker plates.

Sample A was prepared by knitting a twisted yarn formed from a non-acetalized polyvinyl alcohol yarn (vinylon: Trademark, 650 deniel/250 filaments, shrinking percentage: 25%) and a yarn sold under the trade name, Toray Sa-7 (150 deniel) made by Toray Co., as the ground yarn, and a twisted yarn formed from two yarns selled under the trade name, Toray SA-7 (150 deniel) made by Toray Co., as the pile yarn.

Sample B was prepared by knitting a twisted yarn formed from a non-acetalized polyvinyl alcohol yarn (vinylon: Trademark, 650 deniel/250 filaments, shrinking percentage: 25%) and a yarn sold under the trade name, Toray SA-7 (150 deniel) made by Toray Co., as the ground yarn, and a yarn, Toray SA-7 (150 deniel) made by Toray Co., as the pile yarn.

Sample C was prepared by knitting a non-acetalized polyvinyl alcohol yarn (vinylon: Trademark, 650 deniel/250 filaments, shrinking percentage: 25%), as the ground yarn, and a twisted yarn formed from two yarns of Toray SA-7 (150 deniel) as the pile yarn.

Comparative sample D was prepared by knitting a non-acetalized polyvinyl alcohol yarn (vinylon: Trademark, 650 deniel/250 filaments, shrinking percentage: 25%), as the ground yarn, and four acryl yarns, Pyuron (Trademark: 125 deniel) as the pile yarn.

The samples were subjected to measurements of electrostatic properties including a charged potential, a half-life of the charged potential, a charge density, a surface resistivity and specific resistance. The charge density was measured after rubbing the sample with acryl or nylon fabric. Results are shown in Table 1.

TABLE 1

| Sample | D | A | B | C |
|---|---|---|---|---|
| Charged potential (Kv) | 7.1 | 0.15 | 0.15 | 0.30 |
| Half-life (sec) | 180 | 5.0 | 5.6 | 4.7 |
| Density ($\mu c/m^2$) | | | | |
| Acryl | 15.2 | 1> | 1> | 1> |
| nylon | 17.6 | 1> | 1> | 1> |
| surface resistivity (Ω) | $4 \times 10^{14}$ | $4 \times 10^{9}$ | $8 \times 10^{9}$ | $6 \times 10^{9}$ |
| specific resistance (Ω-cm) | $3 \times 10^{14}$ | $1 \times 10^{8}$ | $2 \times 10^{8}$ | $3 \times 10^{8}$ |

As can be seen from the results shown in Table 1, the samples A, B and C according to the present invention are superior in destaticizing properties to the comparative sample D.

EXAMPLE 2

Antistatic covers composed of the tubular fabric with a diameter of about 22.3 mm shown in FIG. 4 were prepared by knitting a non-acetalized polyvinyl alcohol yarn (vinylon: Trademark, 650 deniel/250 filaments, shrinking percentage: 25%), as the ground yarn, and a yarn, Toray SA-7 (150 deniel) made by Toray Co., as the pile yarn, with a circular knitting machine comprising a 2.5 inch cylinder.

Figure 5:
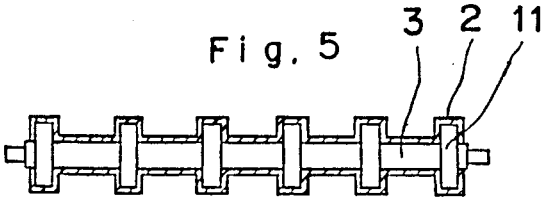
FIG. 5 is a sectional view of a roller provided with an antistatic cover according to the present invention.
Figure 6:
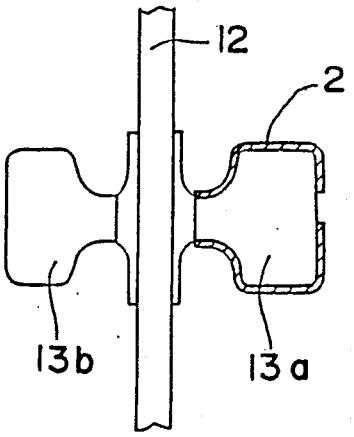
FIG. 6 is a partial sectional view of a door knob provided with an antistatic cover according to the present invention.

The covers were respectively securely fastened to a paper feeding roller shown in FIG. 5 and a paper discharging roller shown in FIG. 1 by thoroughly wetting the cover mounted on the roller so that the water-shrinkable or heat shrinkable ground yarn shrinks causing fabric to tighten down on the roller. The paper feeding roller shown in FIG. 5 comprises a stainless steel shaft 3 of a 10 mm diameter and a 350 mm length provided with six spaced rubber rings 11 of a 40 mm diameter and a 14 mm width. The paper discharging roller shown in FIG. 1 comprises a rubber coated roller of a 30 mm diameter and a 350 mm length.

The rollers provided with the antistatic cover were assembled in a electrophotographic copying apparatus and copies were taken with plain paper with a charged potential of 9 Kv. The potential of the copy was reduced to 4 Kv.

EXAMPLE 3

Antistatic covers composed of a tubular fabric shown in FIG. 2 with a diameter of 41.4 mm was prepared by knitting a twisted yarn formed from a non-acetalized polyvinyl alcohol yarn (vinylon: Trademark, 650 deniel/250 filaments, shrinking percentage: 25%) and two yarns, Toray SA-7 (150 deniel) made by Toray Co., as the ground yarn, and a 150 deniel colored woolly nylon yarn, as the pile yarn.

The cover was securely fastened to one of metal knobs 13*a*, 13*b* mounted on a wooden door 12, in the same manner as in Example 2. When a metal rod is brought close to the knob 13*b* charged to a potential of about 10 Kv with an static charge generator, a spark was emitted from the knob 13*b*. In contrast thereto, no spark was emitted from the knob 13*a* provided with the antistatic cover 2 even when a potential of about 10 Kv was applied to the knob 13*a* with the static charge generator. The potential of the charged knob 13*a* was about 0.5 Kv and no electric shock was received.

In the foregoing embodiments, all the antistatic covers are composed of a fabric comprising pile yarns worked into each course of the ground fabric, but pile yarns may be omitted from the fabric.

What I claim is:

1. A tubular knitted fabric antistatic cover comprising two shrinkable ground yarns, said tubular knitted fabric having a tubular double plain knitted fabric structure wherein said two ground yarns are each alternatively knitted so that needle loops in each course of a ground fabric are alternately formed by said respective two ground yarns to form sinker loops each having a width longer than that of the corresponding needle loop in each said course of said ground fabric, and further wherein said ground yarns are selected from the group consisting of water-shrinkable yarns and heat-shrinkable yarns, at least one of said ground yarns containing fibers selected from the group consisting of charge control fibers and electrically conductive fibers, said tubular fabric having a radial shrinking percentage of generally between about 20 to 25% and an axial shrinking percentage of generally between about 25 to 30%.

2. The antistatic cover of claim 1, wherein said ground yarn consists of nonacetalized polyvinyl alcoholic fibers, chemical fibers, reproduced fibers and natural fibers.

3. A tubular knitted fabric antistatic cover comprising two shrinkable ground yarns and two hydrophilic pile yarns, said tubular knitted fabric having a tubular double plain knitted fabric structure wherein said two ground yarns are each alternately knitted so that needle loops in each course of a ground fabric are alternately formed by said respective two ground yarns to form sinker loops each having a width longer than that of the corresponding needle loop in each said course of said ground fabric, and further wherein said ground yarns are selected from the group consisting of water-shrinkable and heat-shrinkable yarns, each of said pile yarns being worked into each course of said ground fabric and being alternately knitted together with a needle mesh of the respective ground fabrics to form raised loops, at least one of the ground yarns and pile yarns containing fibers selected from the group consisting of charge control fibers and electrically conductive fibers, said tubular fabric having a radial shrinking percentage of generally between about 20 to 25% and an axial shrinking percentage of generally between about 25 to 30%.

4. The antistatic cover of claim 3, wherein said ground yarn consists of nonacetalized polyvinyl alcoholic fibers, chemical fibers, reproduced fibers and natural fibers.

* * * * *